United States Patent [19]

Cochran

[11] 4,294,270

[45] Oct. 13, 1981

[54] HAIR TREATING FLUID APPLICATOR

[76] Inventor: Loretta L. Cochran, 807 Corvallis Dr., Sunnyvale, Calif. 94087

[21] Appl. No.: 834,188

[22] Filed: Sep. 19, 1977

[51] Int. Cl.[3] ..... A45D 24/22

[52] U.S. Cl. ..... 132/112

[58] Field of Search ..... 132/112, 113–114, 132/111, 120, 9, 88.5, 88.7; 128/260 T

[56] References Cited

U.S. PATENT DOCUMENTS

| | | | |
|---|---|---|---|
| 2,263,475 | 11/1941 | Strauch | 132/120 |
| 2,299,295 | 10/1942 | Battle | 132/120 |
| 2,376,065 | 5/1945 | Kuszyk | 132/114 |
| 2,594,721 | 4/1952 | Beebe | 132/111 |
| 2,610,627 | 9/1952 | Fuentes | 132/120 |
| 2,617,431 | 11/1952 | Gaspari | 132/120 |
| 2,705,499 | 3/1955 | Breeze | 132/9 UX |
| 3,477,447 | 11/1969 | Eldredge | 132/113 |
| 3,762,425 | 10/1973 | Loeffler | 132/110 |
| 3,961,635 | 6/1976 | Miya | 132/113 |

*Primary Examiner*—G. E. McNeill

*Attorney, Agent, or Firm*—Jack M. Wiseman; Francis W. Anderson

[57] ABSTRACT

A fountain comb in which a manifold backbone has communication with a reservoir through a screw cap and is angularly disposed relative to the reservoir which serves as a handle, the comb having a plurality of teeth extending from the backbone at right angles thereto with axial passages communicating with the manifold to supply fluid to the tips of the teeth, the latter being in arcuate array to conform to scalp contour, and a bumper sponge and a brush on the backbone of the comb for collecting, spreading and/or distributing fluid to the hair by methods known as streaking, tipping, straight and in circle brush painting around and within curls and the like.

6 Claims, 7 Drawing Figures

HAIR TREATING FLUID APPLICATOR

This invention relates to devices for treating the scalp and hair and more particularly to fluid applicators.

BACKGROUND

In the art of hair dying, tinting and the like the most difficult problem is to handle the hair while using prior known types of applicators. The most common and widely used form of applicator is a fountain comb having a hand controlled fluid supply for feeding the hair treating fluid to the scalp and layers of hair as the hair is laid back.

The operation usually requires the use of both hands of the hair stylist, one hand to support and manipulate the fountain comb and the other to section and sponge the strands of hair and to mop up excess fluid. This calls for a supply of wads, sponges and side dishes for the mop up and distribution. The operator is, therefore, required to wear rubber gloves, especially when bleaching fluids and other chemically treated solutions are fed through the applicator. With the foregoing equipment it takes a skilled operator from 20 to 30 minutes on virgin bleaching. Tinting and touching up may take from 15 to 20 minutes by a skillful operator. With the introduction of new additives such as magneseum, lecithin and vitamins into the fluids, the tint and/or the bleaching process takes place more quickly. This decreases the time the operator may have to manipulate the applicator and sponges as heretofore required.

STATEMENT OF THE INVENTION

The present invention contemplates the provision of an applicator for the latest technology in hair coloring, bleaching and any chemical or medical treatments associated therewith.

It is an object of this invention to provide a fountain comb integrally formed on and with a neck portion of a cap screw adapted for sealed connection to a plastic container for fluid.

It is another object to provide such applicator with the backbone of the comb portion disposed at an angle relative to the neck portion, cap and container whereby the latter provides a suitable pressure sensitive handle for manipulating and feeding fluid from the applicator.

It is still another object to provide the teeth of the comb with fluid passages in communication with a manifold formed within the backbone of the comb and volumetrically calculated to emit fluid evenly out of all teeth simultaneously upon manipulation of the applicator by finger pressure to the plastic container.

It is another object to provide a thermal plastic body to the comb and plastic container for handling hot applications of fluid therefrom.

It is yet another object to provide such an applicator in which the discharge end of the teeth of the comb are arcuately disposed such that they conform substantially to the curvature of a persons scalp during use of the applicator.

It is still further an object of this invention to provide the applicator with a fluid absorbing member in proximity to the teeth of the comb at one side of the backbone thereof. In this connection it is an object to provide a bumper sponge on the comb backbone for the purpose aforesaid.

It is still another object to provide the applicator with a brush member for aiding and assisting in the even distribution of fluid to the hair of a person.

These and other objects and advantages of the present invention will become apparent from a reading of the following description and claims in the light of the accompanying drawing in which:

GENERAL DESCRIPTION

Figures 1, 2, 3, 4, 5, 6, 7:
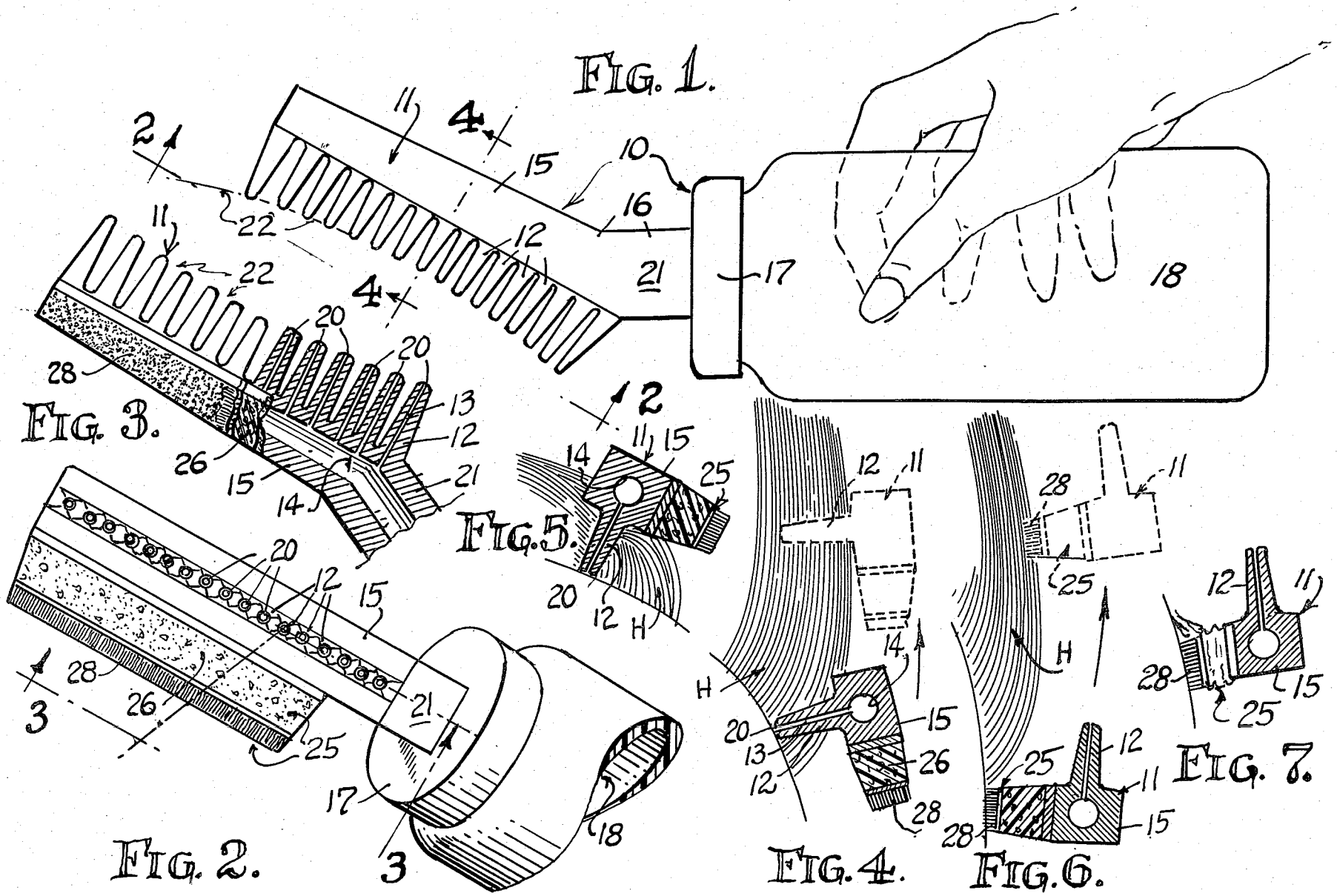
FIG. 1 is a side elevation of the applicator attached to a fluid supply container.
FIG. 2 is a view looking directly into the comb portion only of FIG. 1 as seen from line 2—2 thereof.
FIG. 3 is a view of the comb portion partly in elevation and partly in section of FIG. 2 taken substantially along line 3—3 therein.
FIG. 4 is a section through the comb portion of FIG. 1 at line 4—4 thereof and illustrating the applicator in use relative to human hair.
FIG. 5 is a view similar to that of FIG. 4 showing the comb in a different position relative to a persons scalp.
FIG. 6 is a view similar to that of FIGS. 4 and 5 showing the applicator used as a tinting brush.
FIG. 7 is a view similar to that of FIGS. 4 and 5 showing the swabing sponge compressed and about to absorb driplets of tint fluid from a persons scalp.

The applicator 10 of the present invention has its embodiment in a fountain comb 11 the teeth 12 of which are provided with a passage 13 in communication with a manifold core 14 in the backbone 15 of the comb. One end 16 of the backbone 15 of the comb is connected to a screw cap 17 adapted for threaded connection with a suitable reservoir or supply source of liquid such as a receptacle 18 in communication with the comb 11 of the applicator 10. The foregoing arrangement is common to prior known applicators for controlling the flow of liquid emitting from the open tips 20 of the teeth of such fountain combs by hand gripping the plastic receptacle 18.

DETAILED DESCRIPTION

In accordance with the objects and advantages of the present invention, the comb 11 has its backbone 15 disposed at an obtuse angle relative to a neck portion 21. The neck portion 21 is disposed parallel to and in substantial alignment with the axis of the screw cap 17. By this arrangement a hair stylist operator manipulating the applicator 10 by means of the handle-like receptacle 18 has a better view of the flow of fluid and distribution thereof to a patients scalp and hair.

As a further aid to even application and flow control of the fluid from the comb tips 20, the latter are disposed in an arc 22, relative to each other. The arcuate disposition of the comb tips 20 is segmentally comparable to the curvature of a human skull such that the tips 20 of the comb teeth 12 conform substantially to the contour thereof as the comb is manipulated by the hair stylist operator.

In this connection it should be noted that all of the passages 13 in the comb teeth 12 are calculated to emit a total volume no greater than that of the supply manifold 14 so that the fluid emits uniformly from the tips 20 of the comb of the present invention.

The entire comb, its backbone neck and the screw cap are formed integrally of plastic material resistant to chemicals and the like and the plyable receptacle 18 is preferably made of a thermo plastic of like nature for the handling of hot oils and fluids in the applicator 10.

With the applicator 10 thus formed in accordance with the present invention the hair stylist, operator, gripping the handle-like recepticle by one hand has her other hand free to comb and brush a patients hair. This is known as layering by parting the hair into layers for application of fluid therebetween.

Whereas it was heretofore necessary to layer a patient's hair in $\frac{1}{8}$ inch partings, the applicator 10 of the present invention provides means 25 by which the application can be made in 2-inch layers or folds of hair.

The means 25 comprises a bumper sponge 26 on one side of the comb backbone 15. The bumper sponge 26 extends parallel to the teeth of the comb and to one side thereof for the purpose of taking up any excess fluid emitted from the tips 20 of the comb teeth 12. It should here be noted that the means 25 may be mounted on either side of the comb backbone for use by left handed operators as well as right handed persons.

The bumper sponge 26 is not only useful in collecting excessive fluid but is a carrier thereof which upon being pressed (FIG. 7) aids in distributing the fluid over wider areas of hair.

In addition to the bumper sponge, a many tufted fine bristled brush 28 is mounted on the backbone of the comb in proximity to the teeth thereof. As best seen in FIGS. 2 and 3 the brush 28 is preferably mounted on the outer face of the bumper sponge 26. The bristles 29 of the brush extend laterally outward from the sponge 26 and comb 11 for combined action therewith in spreading and applying the fluid to the hair of a patient under treatment.

Having thus described the structural aspects of the applicator 10 of the present invention, the following is an explanation of the use thereof in skillfully applying a bleach, tinting solution and or other scalp and hair treating fluids to the hair of a human being.

Referring first to FIG. 4, a good two-inch layer of hair H is shown having the tips 20 of the comb 11 applying fluid close to the scalp. This is necessary in the bleaching or tinting of virgin hair. Virgin hair as used herein refers to hair that has not ever been tinted or bleached before, thus requiring application close to the scalp and follicle area of the hair. In such application the arcuate row of tips 20 of the teeth 12 may be combed through the layer of hair toward a position such as is illustrated in FIG. 5.

By skillfully squeezing the plastic receptacle 18 the fluid is emitted evenly and uniformly from all teeth simultaneously. By releasing the pressure against the plastic recepticle, excessive fluid within the manifold 14 and passages 13 of the comb teeth is withdrawn or withheld.

In the event the flow of fluid onto the scalp becomes excessive, the operator need only turn the comb head with teeth up as shown in FIG. 6 so that fluid can be picked up and absorbed by the bumper sponge 26. At the same time the brush 28 may be swept upwardly (dotted lines FIG. 6) over the layer of hair to distribute fluid thereto. By squeezing the bumper sponge against the strands of hair and scalp as illustrated in FIG. 7, fluid in the sponge exudes therefrom for use in feathering application of the tint and/or bleach.

It should here be noted that most of the operations of the applicator are carried on by one hand. Only on rare accassion or in the hands of a less adept operator would additional mopping, swabs and the like be required. It will therefore be appreciated that there is less need for the operator to wear rubber gloves thus enhancing his agility in using the applicator.

The applicator constructed in accordance with the present invention is further useful in the art of hair coloring, tinting and the like. With the brush 28 juxtaposed adjacent the comb, an operator can achieve styles of hair painting. Streaking of long strands of hair, applying fluid in circles as within and/or around curls of hair, half moon tipping and just plain tipping of hair strands of a patient.

From the foregoing it will be appreciated that I have provided a novel tool for use in the new and modern systems of hair bleaching, tinting and treatment. While I have described my new applicator in specific detail, it will be appreciated that the same may be modified, altered and/or varied without departing from the spirit or scope of my invention therein as called for in the appended claims.

I claim:

1. An applicator for depositing and distributing a fluid onto the hair of a human being comprising:

(a) a fluid supply reservoir having an open end;

(b) a cap portion attached to said open end of said supply reservoir, said cap portion having a passage formed therethrough for communication with the interior of said supply reservoir;

(c) a fountain comb including a backbone secured to said cap portion and having a manifold passage in communication with the passage formed through said cap portion;

(d) A plurality of comb teeth extending in parallel relation to one another from the backbone of said comb and each having a passage formed lengthwise therethrough for communication with the manifold passage in said backbone;

(e) a bumper sponge on said backbone of said comb for absorbing and mopping excess fluid from the scalp and hair under treatment, said bumper sponge being disposed on one side of said backbone of said comb displaced in the vicinity of 90° degrees from the side of said backbone of said comb from which said comb teeth project and having an outer surface opposite the surface thereof on said backbone of said comb; and (f) a brush on said outer surface of said sponge for spreading the fluid relative to strands and curls of hair under treatment, said brush having bristles extending laterally outward from the outer surface of said sponge for combined action with said sponge in spreading and distributing the fluid over hair under treatment.

2. The applicator device in accordance with claim 1 in which said bumper sponge is of foam rubber impervious to caustics and acids.

3. An applicator as claimed in claim 1 in which said plurality of comb teeth have comb tips opposite said backbone arranged in arcuate array for conforming substantially to the curvature of a human scalp.

4. An applicator as claimed in claim 1 in which said backbone of said comb is disposed at an obtuse angle relative to the axis of said cap portion in a direction directed away from said plurality of comb teeth for facilitating manipulation of the teeth tips relative to the scalp of a human being.

5. An applicator as claimed in claim 3 in which said plurality of comb teeth have the collective passages formed therein of a volumetric capacity comparable to that of the manifold passage in said comb backbone for controlling uniform and equal flow of fluid simultaneously at the tips of each tooth of the comb.

6. An applicator as claimed in claim 5 in which said backbone of said comb is disposed at an obtuse angle relative to the axis of said cap portion in a direction directed away from said plurality of comb teeth for facilitating manipulation of the arcuately arranged teeth tips relative to the scalp of a human being.

* * * * *